US009695496B2

(12) United States Patent
Schaffrath et al.

(10) Patent No.: US 9,695,496 B2
(45) Date of Patent: Jul. 4, 2017

(54) METHOD AND DEVICE FOR AVOIDING SURFACE DEFECTS CAUSED BY ZINC DUST IN A CONTINUOUS STRIP GALVANISING PROCESS

(71) Applicant: THYSSENKRUPP STEEL EUROPE AG, Duisburg (DE)

(72) Inventors: Norbert Schaffrath, Hamm (DE); Sabine Zeizinger, Mülheim (DE); Michael Peters, Kleve (DE); Gernot Nothacker, Dortmund (DE); Klaus Josef Peters, Krefeld (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 0 days.

(21) Appl. No.: 14/412,929

(22) PCT Filed: Jul. 5, 2013

(86) PCT No.: PCT/EP2013/064249
§ 371 (c)(1),
(2) Date: Jan. 5, 2015

(87) PCT Pub. No.: WO2014/006183
PCT Pub. Date: Jan. 9, 2014

(65) Prior Publication Data

US 2015/0167138 A1 Jun. 18, 2015

(30) Foreign Application Priority Data

Jul. 6, 2012 (DE) ..... 10 2012 106 106

(51) Int. Cl.
*B05D 3/02* (2006.01)
*C23C 2/02* (2006.01)
(Continued)

(52) U.S. Cl.
CPC ..... *C23C 2/02* (2013.01); *C21D 1/26* (2013.01); *C21D 9/52* (2013.01); *C21D 9/561* (2013.01);
(Continued)

(58) Field of Classification Search
CPC ..... B05D 3/002; B05D 3/0236; C23C 2/02; C23C 2/06; C23C 2/003; C23C 2/40; C21D 9/561; C21D 9/52
(Continued)

(56) References Cited

FOREIGN PATENT DOCUMENTS

JP H07 157853 A 6/1995
JP H07 157854 A 6/1995
(Continued)

OTHER PUBLICATIONS

German Language International Search Report for International patent application No. PCT/EP2013/064249; mailing date Oct. 4, 2013.
(Continued)

*Primary Examiner* — Kirsten Jolley
(74) *Attorney, Agent, or Firm* — thyssenkrupp North America, Inc.

(57) ABSTRACT

The invention relates to a method and to an apparatus for avoiding surface defects, which are caused by zinc dust, on galvanized metal strip in continuous strip galvanization, in which metal strip which is to be galvanized and is heated in a continuous annealing furnace is moved through a furnace pipe in protective furnace gas and is immersed into a zinc bath, wherein the furnace pipe is provided with injection openings via which the front side and the rear side of the metal strip can be acted upon with protective furnace gas, and wherein extraction openings for extracting protective furnace gas loaded with zinc vapor are arranged adjacent to the injection openings. The apparatus according to the
(Continued)

invention is characterized in that a multiplicity of the injection openings are configured and arranged in the furnace pipe in such a manner that the protective furnace gas streaming out of said injection openings is directed onto that surface of the metal strip which faces the respective injection opening with an angle of impact within the range of 70° to 110°, wherein the distance between the respective injection opening and at least one extraction opening assigned thereto is selected in such a manner that, at a predetermined or predeterminable flow velocity of the protective furnace gas emerging from the respective injection opening, an entraining of protective furnace gas, which occurs during movement of the metal strip, in the direction of the zinc bath is opposed.

18 Claims, 5 Drawing Sheets

(51) Int. Cl.

| | |
|---|---|
| ***C21D 9/56*** | (2006.01) |
| ***C23C 2/00*** | (2006.01) |
| ***C23C 2/06*** | (2006.01) |
| ***C23C 2/40*** | (2006.01) |
| ***C21D 1/26*** | (2006.01) |
| ***C21D 9/52*** | (2006.01) |
| *B05D 3/00* | (2006.01) |

(52) U.S. Cl.
CPC ..... *C23C 2/003* (2013.01); *C23C 2/06* (2013.01); *C23C 2/40* (2013.01); *B05D 3/002* (2013.01); *B05D 3/0236* (2013.01)

(58) Field of Classification Search
USPC ..... 427/321, 328
See application file for complete search history.

(56) References Cited

FOREIGN PATENT DOCUMENTS

| | | |
|---|---|---|
| JP | H09 228016 A | 9/1997 |
| JP | H11 302811 A | 11/1999 |

OTHER PUBLICATIONS

English Translation of International Search Report for International patent application No. PCT/EP2013/064249; mailing date Oct. 4, 2013.
English Translation of abstract of JPH07157854 (A).
English Translation of abstract of JPH09228016 (A).
English Translation of abstract of JPH11302811 (A).
English Translation of abstract of JPH07157853 (A).
German Language Written Opinion of the International Searching Authority for International patent application No. PCT/EP2013/064249; Date of issuance of report, Jan. 6, 2015.
English Translation of the Written Opinion of the International Searching Authority for International patent application No. PCT/EP2013/064249; Date of issuance of report, Jan. 6, 2015.
German Language International Preliminary Report on Patentability with Written Opinion (CH 1) for International patent application No. PCT/EP2013/064249; Date of issuance of report, Jan. 6, 2015.

METHOD AND DEVICE FOR AVOIDING SURFACE DEFECTS CAUSED BY ZINC DUST IN A CONTINUOUS STRIP GALVANISING PROCESS

CROSS REFERENCE TO RELATED APPLICATIONS

This application is a U.S. National Stage Entry of International Patent Application Serial Number PCT/EP2013/064249, filed Jul. 5, 2013, which claims priority to German patent application no. 102012106106.8, filed Jul. 6, 2012.

FIELD

The invention relates to a method for avoiding surface defects, which are caused by zinc dust, on a galvanized metal strip in continuous strip galvanization, in which metal strip heated in a continuous furnace is moved through a furnace pipe in protective furnace gas and is immersed into a zinc bath. Furthermore, the invention relates to an apparatus for avoiding surface defects, which are caused by zinc dust, on a galvanized metal strip in continuous strip galvanization.

BACKGROUND

A plant for continuous hot-dip galvanization of steel strip consists, inter alia, of a continuous furnace, a zinc bath (molten bath), an apparatus for adjusting the zinc coating thickness and a downstream cooling device. The steel strip is continuously annealed in the continuous furnace. The desired mechanical properties of the basic material are adjusted here by recrystallization of the steel. In addition, iron oxides FORMED in a preheating zone are reduced here. In a cooling zone downstream of the continuous annealing furnace, the strip is cooled in protective furnace gas (HNX) to a temperature close to the molten bath temperature. The protective furnace gas is intended to prevent the annealed strip from oxidizing prior to galvanization, which would considerably impair the adhesion of the zinc coating. The connecting piece containing protective furnace gas between annealing furnace and zinc bath is called furnace pipe.

In a conventional furnace pipe of a continuous strip galvanization plant, there are customarily deposits of zinc dust which, in particular in the event of vibrations occurring in the plant, drops in relatively large pieces onto the zinc bath and/or the steel strip and therefore causes surface defects (galvanization defects). It has been detected that the steel strip moving in the pipe in the direction of the zinc bath entrains protective furnace gas downwards, wherein the entrained protective furnace gas on the zinc bath surface absorbs zinc vapour which, as the entrained protective furnace gas rises, condenses or resublimates on the colder inner walls of the pipe and is deposited there as dust.

JP 7157853 (A) discloses an apparatus for removing zinc vapour in a pipe of a continuous strip galvanization plant. In order to remove the zinc vapour arising on the zinc bath surface, the furnace pipe is provided with injection openings (recirculating openings) and extraction openings arranged vertically therebelow. In a first exemplary embodiment, an individual injection opening and, vertically therebelow, an individual extraction opening are arranged in the pipe wall facing the upper side of the steel strip. Accordingly, an individual injection opening and, vertically therebelow, an individual extraction opening are likewise arranged in the pipe wall facing the lower side of the steel strip. In a second exemplary embodiment, an individual injection opening is arranged in a side wall of the pipe, while two extraction openings are provided vertically below said injection opening, the extraction openings being configured as longitudinal slots in conduits which penetrate the side wall of the pipe and extend over the entire steel strip width on the upper side and lower side of the steel strip.

With the apparatus known from JP 7157853 (A), a relatively large quantity of zinc vapour or zinc dust has to be removed from the extracted protective furnace gas. This is because, on the basis of the configuration and arrangement of the injection openings and extraction openings, it can be assumed that said known apparatus promotes the absorption of zinc vapour by the protective furnace gas entrained by the steel strip and promotes the dissemination of zinc vapour in the furnace pipe.

SUMMARY

The present invention is based on the object of indicating a method and an apparatus of the type mentioned at the beginning, with which the absorption of zinc vapour by the protective furnace gas contained in the furnace pipe and the dissemination of zinc vapour in the furnace pipe can be significantly minimized.

BRIEF DESCRIPTION OF THE DRAWINGS

The present disclosure is described in detail below with reference to the attached drawing figure, wherein:

FIG. 5 is a partial top cross sectional view through a section of the furnace pipe of FIG. 4, showing the metal strip to be galvanized passing there through.

DETAILED DESCRIPTION

Figure 1:
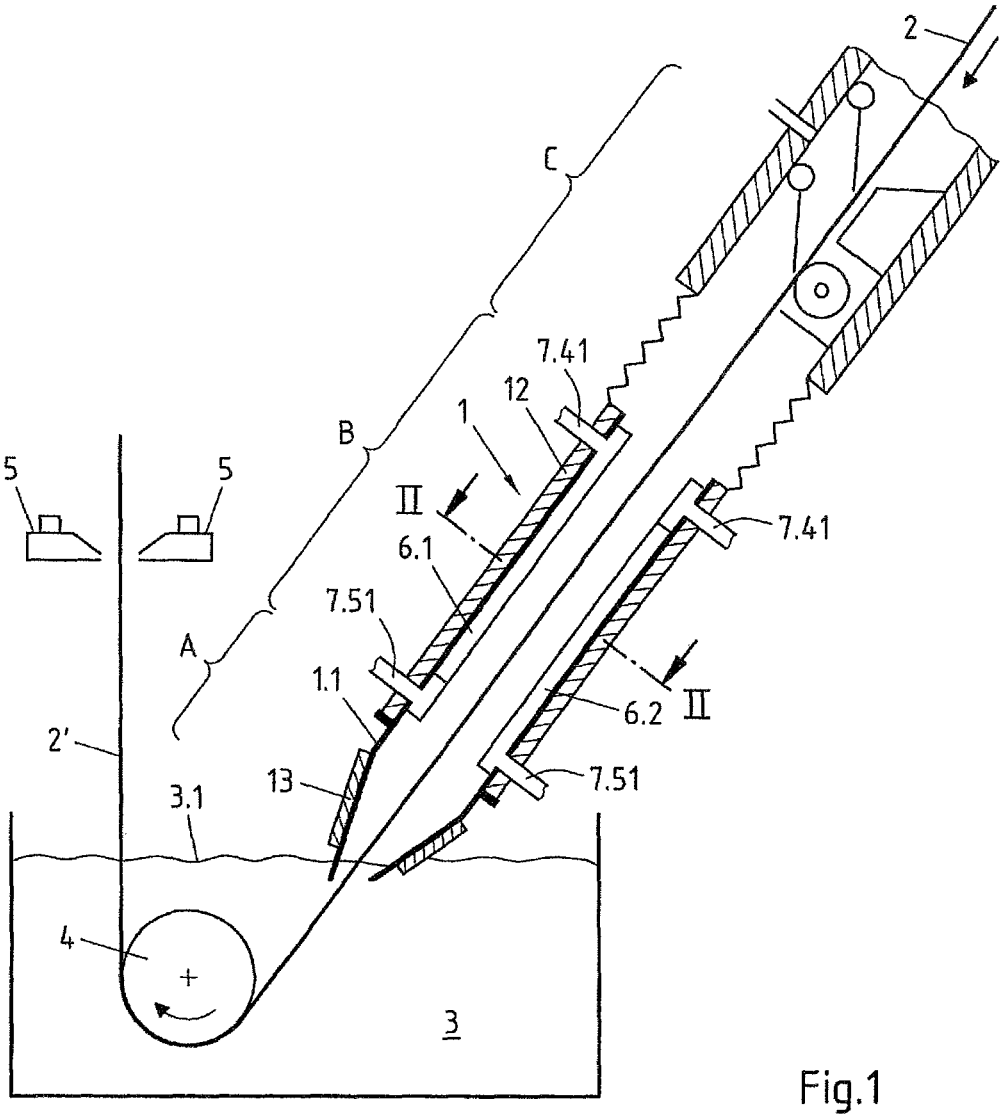
FIG. 1 is a schematic, cross-sectional, partial side view showing a section of an embodiment of a furnace pipe used in a continuous strip galvanization process, as disclosed herein.

In the method according to the invention, the upper side and the lower side of the metal strip (for example steel strip) to be galvanized are likewise acted upon in the furnace pipe with protective furnace gas via injection openings. Protective furnace gas loaded with zinc vapour and/or zinc dust is extracted via extraction openings which are arranged on both sides of the metal strip adjacent to the injection openings. According to the invention, a multiplicity of the injection openings are configured and arranged in the furnace pipe in such a manner that the protective furnace gas streaming out of said injection openings is directed onto that surface of the metal strip which faces the respective injection opening with an angle of impact within the range of 70° to 110°, preferably 80° to 100°, particularly preferably approx. 90°. In addition, the distance between the respective injection opening and at least one extraction opening assigned thereto is selected in such a manner, and the flow velocity of the protective furnace gas emerging from the respective injection opening is controlled in such a manner, that an entraining of protective furnace gas, which occurs during movement of the metal strip or steel strip, in the direction of the zinc bath is opposed.

In the apparatus according to the invention, the furnace pipe is therefore provided with injection openings via which the upper side and the lower side of the metal strip can be acted upon by protective furnace gas, wherein extraction openings for extracting protective furnace gas loaded with zinc vapour and/or zinc dust are arranged adjacent to the injection openings. According to the invention, a multiplicity of the injection openings are configured and arranged in the furnace pipe in such a manner that the protective furnace gas streaming out of said injection openings is directed onto that surface of the metal strip which faces the respective injection opening with an angle of impact within the range of 70° to 110°, preferably 80° to 100°, particularly preferably approx. 90°, wherein the distance between the respective injection opening and at least one extraction opening assigned thereto is selected in such a manner that, at a predetermined or predeterminable flow velocity of the protective furnace gas emerging from the respective injection opening, an entraining of protective furnace gas, which occurs during movement of the metal strip, in the direction of the zinc bath is opposed.

The invention is based on the concept of influencing the flow conditions of the protective furnace gas, in particular in the vicinity of the strip, in such a manner that the mentioned entraining of protective furnace gas is minimized and/or the condensation or resublimation of zinc vapour on the walls of the pipe is prevented. In contrast to the apparatus known from JP 7157853 (A), it is the object of the present invention already in advance to prevent the formation of protective furnace gas loaded with zinc vapour by the entraining of the protective furnace gas in the direction of the zinc bath being minimized. To this end, the invention proposes an interruption or blocking of the protective furnace gas (stream of protective furnace gas) entrained by the metal strip by the use of a gas block effect or gas veil effect.

In an advantageous refinement of the method according to the invention, the protective furnace gas supplied via the injection openings is heated beforehand to a temperature of at least 500° C., preferably at least 550° C. By means of this refinement, the resublimation of zinc dust in the furnace pipe can be prevented even more effectively since the heated stream of protective furnace gas supplied via the injection openings keeps the zinc vapour, which arises on the zinc bath surface, in the gaseous state.

Accordingly, in a preferred refinement of the apparatus according to the invention, the extraction openings are connected to the injection openings via a return line having at least one extraction ventilator, wherein the return line is provided with at least one heating device for heating the protective furnace gas to a temperature of at least 500° C., preferably at least 550° C.

The stream of protective furnace gas admitted into the pipe over a large area and uniformly substantially over the entire pipe width at the same time constitutes a heating medium for the blowing/suction apparatus and prevents cold zones, which would lead to precipitation of the zinc dust, in the pipe. The disclosed temperature guide in the pipe region results in there not even being any sublimated zinc dust in the pipe. On the contrary, the zinc vapour contained in the protective furnace gas is removed before it can sublimate to form grains of dust.

The method according to the invention is preferably carried out in such a manner that the temperature of the gas cloud is higher in the spatially higher part of the pipe than the temperature in the spatially lower immersion region of the strip. Thermal turbulences in the pipe are thereby minimized.

A further advantageous refinement of the method according to the invention is characterized in that the injection of protective furnace gas via the injection openings and the extraction of protective furnace gas via the extraction openings is carried out in at least three stages which are arranged consecutively in the strip running direction, wherein each of the stages is formed from a series of at least five, preferably at least seven, injection openings and a series of at least five, preferably at least seven, extraction openings. A particularly effective blocking of the protective furnace gas entrained by the strip to be galvanized can thereby be achieved. In particular, by means of the relatively high number of injection openings and extraction openings, a more gentle, low-turbulence blowing flow of protective furnace gas can be produced, and therefore an excessive, uncontrollable swirling of the protective furnace gas and increased strip vibrations are avoided. By means of this multi-stage arrangement of the injection openings and extraction openings, the concentration of the zinc vapour in the protective furnace gas and therefore the partial pressure of the zinc vapour can be gradually reduced to an uncritical mass.

For this purpose, in a preferred refinement of the apparatus according to the invention, the injection openings and the extraction openings are configured in at least three stages which are arranged consecutively in the strip running direction, wherein each of the stages is formed from a series of at least five, preferably at least seven, injection openings and a series of at least five, preferably at least seven, extraction openings.

A further advantageous refinement of the method according to the invention is characterized in that the volumetric flow of protective furnace gas supplied via the injection openings is adjusted to be identical to the volumetric flow of protective furnace gas extracted via the extraction openings, or is adjusted to a value which lies at maximum 5% below the extracted volumetric flow of protective furnace gas. By means of the identical or virtually identical volumetric flows of supplied and extracted protective furnace gas and the mentioned preferred, uniform distribution of injection points and extraction points, the gas turbulence in the pipe is reduced to a minimum.

In order to achieve as effective as possible a blocking or interruption of the stream of protective furnace gas entrained by the moving metal strip while simultaneously minimizing the swirling of the protective furnace gas, it is favourable if, according to a further preferred refinement of the apparatus according to the invention, the injection openings and the extraction openings are arranged in the form of a matrix. It is also favourable in this connection if the injection openings are arranged offset with respect to the extraction openings, as viewed in the strip running direction and over the strip width. The injection openings and the extraction openings of the apparatus according to the invention are preferably arranged uniformly spaced apart from one another.

The distance between the respective injection opening (injection nozzle) and the at least one extraction opening assigned thereto is preferably smaller than/equal to 25 cm, in particular smaller than 15 cm, and particularly preferably smaller than/equal to 10 cm.

In order to realize a low-turbulence interruption of the stream of protective furnace gas entrained by the moving metal strip and in order to achieve as uniform as possible a distribution of the injection points and extraction points, in a further preferred refinement of the apparatus according to the invention the injection openings are formed on teeth-like branches of a comb-shaped blow pipe structure and the extraction openings are formed on teeth-like branches of a comb-shaped suction pipe structure, wherein the teeth-like branches of the comb-shaped blow pipe structure and the teeth-like branches of the comb-shaped suction pipe structure intermesh.

If the stream of protective furnace gas is heated up here, preferably to a temperature within the range of 450 to 600° C., by means of a gas heater prior to the injection, the above-mentioned refinement at the same time has the effect that a very uniform distribution of surface temperature arises during operation on the pipeline system composed of the comb-shaped pipe structures, wherein, when the stream of protective furnace gas is heated to a temperature within the range of 450 to 600° C., the surface temperature of the pipeline system arranged in the pipe lies above the dewpoint or resublimation temperature of zinc. In particular, the heating of the pipeline system with heated-up protective furnace gas prevents the occurrence of concentrated temperature peaks and therefore undesirable gas convection or gas turbulence.

In this connection, in a further advantageous refinement of the apparatus according to the invention, the comb-shaped blow pipe structure and the comb-shaped suction pipe structure are thermally insulated in relation to the furnace pipe by heat insulation.

According to a further preferred refinement of the method according to the invention, the furnace pipe is heated to a temperature of at least 400° C., preferably at least 450° C., at least in a region which extends from the zinc bath as far as the injection openings and/or extraction openings. In addition to a heating device provided for this purpose, or as an alternative thereto, said lower region of the furnace pipe can also be provided, according to a preferred refinement of the apparatus according to the invention, with heat insulation. The effect which can be achieved by this is that the relevant walls or wall sections of the furnace pipe are warmer than the temperature at which the condensation or resublimation of zinc vapour begins.

Further preferred and advantageous refinements of the invention are indicated in the appended claims.

The present disclosure is explained in more detail below with reference to the enclosed drawing figures illustrating a plurality of exemplary embodiments.

The drawing is an outline of a furnace pipe 1 of continuous strip galvanization (hot-dip galvanization). A metal strip 2, preferably steel strip, to be galvanized is annealed in a continuous furnace (not shown) and supplied in protective furnace gas (HNX) to a zinc bath 3. The strip 2 is immersed obliquely downwards into the zinc bath 3 and is deflected upwards by a roller 4 arranged in the zinc bath. The bath temperature is typically within the range of approx. 440 to 470° C. On exiting from the bath 3, the strip 2' entrains a liquid quantity of zinc lying considerably above the desired coating thickness. The excess coating material which is still liquid is stripped off from the upper side and lower side (front side and rear side) of the coated strip 2' by means of air-jet slot nozzles 5 extending over the strip width.

In the furnace pipe 1, some of the protective furnace gas is entrained by the movement of the strip in the direction of the zinc bath 3. In order to prevent the entrained protective furnace gas from absorbing zinc vapour on the zinc bath surface, which zinc vapour is deposited as zinc dust on the colder inner wall surfaces of the pipe 1 and may cause surface defects on the galvanized strip 2', if the zinc vapour drops in relatively large pieces onto the strip 2 and/or zinc bath 3, the pipe 1 is provided with a special blowing/suction apparatus 6.

The blowing/suction apparatus 6 according to the invention has a branched line system 7.1, 7.2 with a multiplicity of injection openings and extraction openings 7.11, 7.21, by means of which protective furnace gas is recirculated in the end region of the pipe 1, i.e. in the vicinity of the zinc bath 3, in such a manner that the stream of protective furnace gas entrained by the strip 2 is interrupted as far as possible, but without increased strip vibrations thereby being caused. For this purpose, the injection openings and extraction openings 7.11, 7.21 are arranged in the direction of movement of the strip 2 in such a manner that each injection opening 7.11 lies in the vicinity of at least one extraction opening 7.21, as a result of which injected protective furnace gas is extracted again in the immediate vicinity and therefore uncontrollable swirling of the protective furnace gas is prevented.

The blowing/suction apparatus 6 comprises an upper part 6.1 and a lower part 6.2, wherein the upper part 6.1 extends over the entire width of the upper side of the strip (front side) while the lower part 6.2 extends over the entire width of the lower side of the strip (rear side). The upper part 6.1 and the lower part 6.2 can in each case be configured in the manner of a box and are accordingly referred to as blowing/suction box or blowing/suction boxes. The respective blowing/suction box (6.1, 6.2) is divided by partitions 7.3 into a branched blowing chamber 7.1' with injection branches 7.10 running parallel to one another and into a branched suction chamber 7.2' with suction branches 7.20 running parallel to one another. An injection branch 7.10 can be located here directly next to a suction branch 7.20 by the two branches 7.10, 7.20 being separated from each other by the same partition 7.3. The division into a branched blowing chamber 7.1' and a branched suction chamber 7.2' can be realized, for example, by a partition 7.3 running or folded in a meandering manner or by partitions which are placed on one another in a meandering manner and are connected to one another in a gas-tight manner at their abutting ends, as sketched in FIG. 5. Connecting pieces 7.41, 7.51 for the connection of at least one return line 8 lead into the main chamber sections 7.4, 7.5, which run transversely with respect to the strip running direction, the return line being connected to a suction fan, suction ventilator 9 or the like and defining or making possible a gas circuit (cf. FIG. 3).

The connecting piece 7.51 for extracting the protective furnace gas is arranged below the connecting piece 7.41 via which the protective furnace gas is supplied (also see FIG. 6). It is thereby ensured that the stream of injected protective furnace gas is always or substantially only directed downwards, as a result of which zinc vapour is effectively prevented from flowing upwards out of the zinc bath into the pipe 1.

Figure 5:
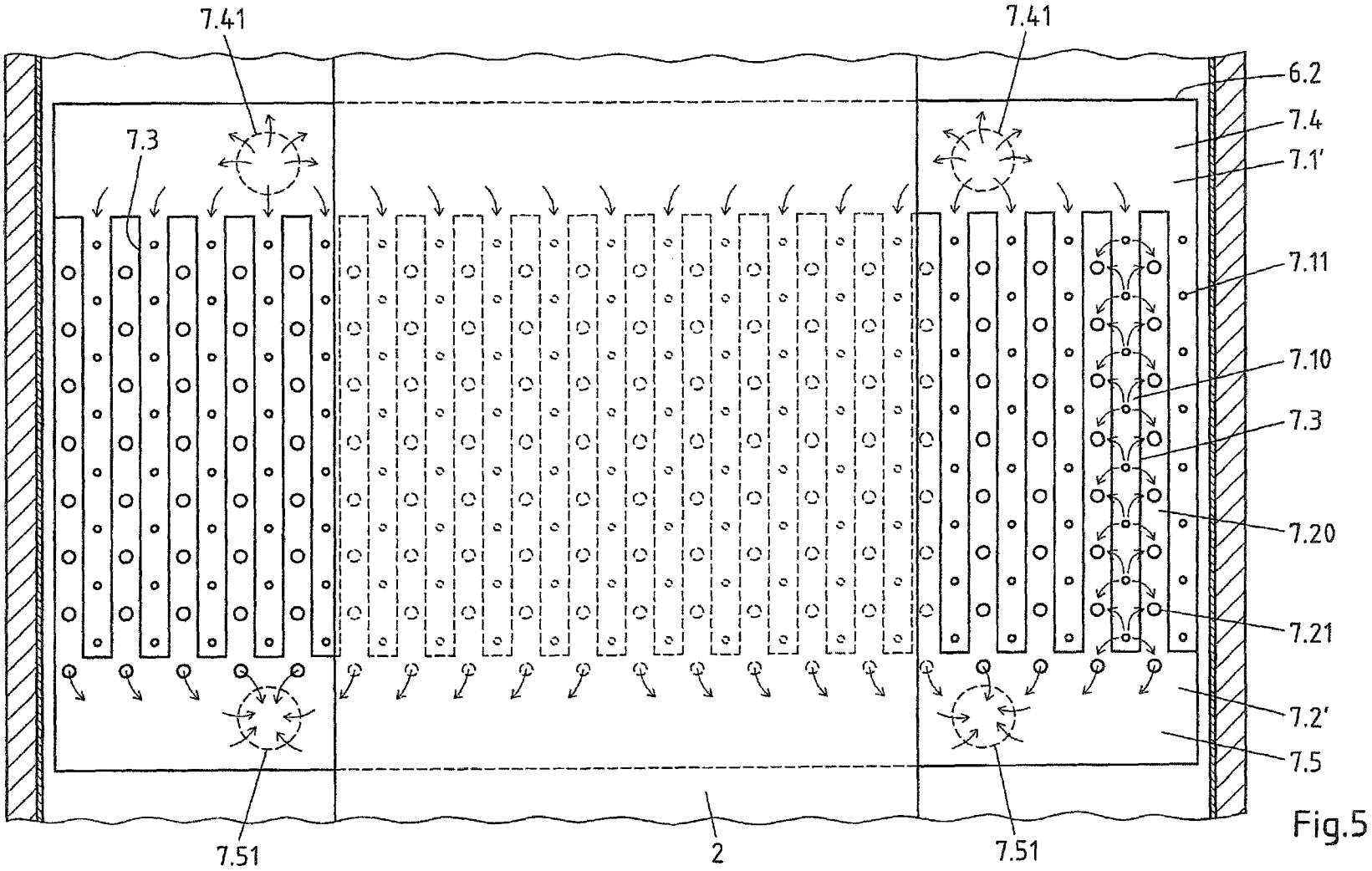
Figure 6:
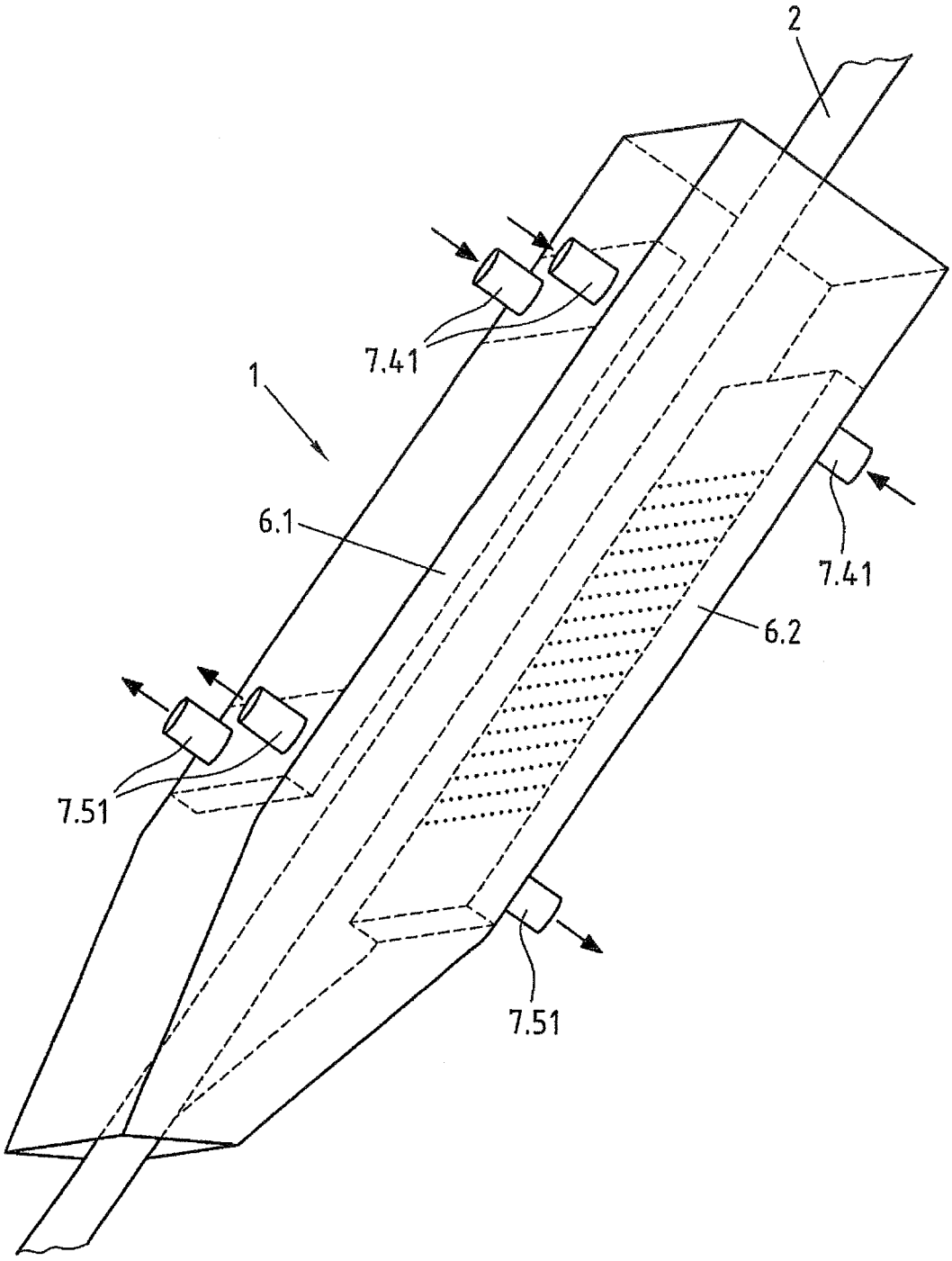
FIG. 6 is a schematic perspective view of the section of the furnace pipe of FIG. 4.

As illustrated in FIGS. 5 and 6, at least two connecting pieces 7.41 for injecting protective furnace gas preferably lead into the upper main chamber section 7.4 of the respective blowing/suction box 6.1 or 6.2, while the lower main chamber section 7.5 of the blowing/suction box 6.1 or 6.2 is preferably provided with at least two connecting pieces 7.51 for extracting protective furnace gas loaded with zinc vapour. The connecting pieces 7.41 of the upper main chamber section 7.4 are arranged here at a distance from one another transversely with respect to the strip running direction. The connecting pieces 7.51 of the lower main chamber section 7.5 are also spaced apart from one another transversely with respect to the strip running direction.

Figure 2:
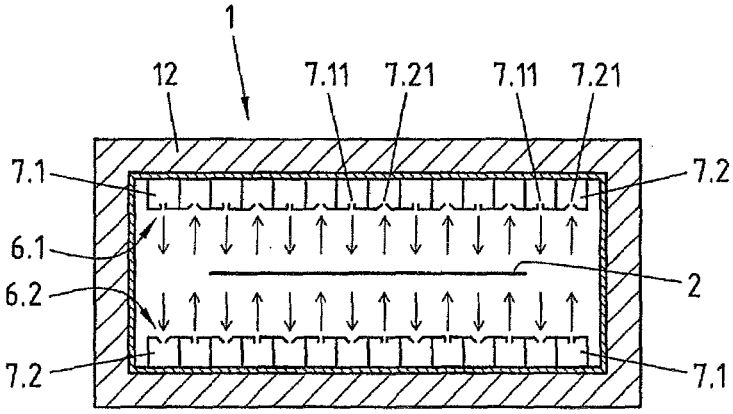
FIG. 2 is a cross sectional view, along section line II-II, of the furnace pipe of FIG. 1.
Figure 4:
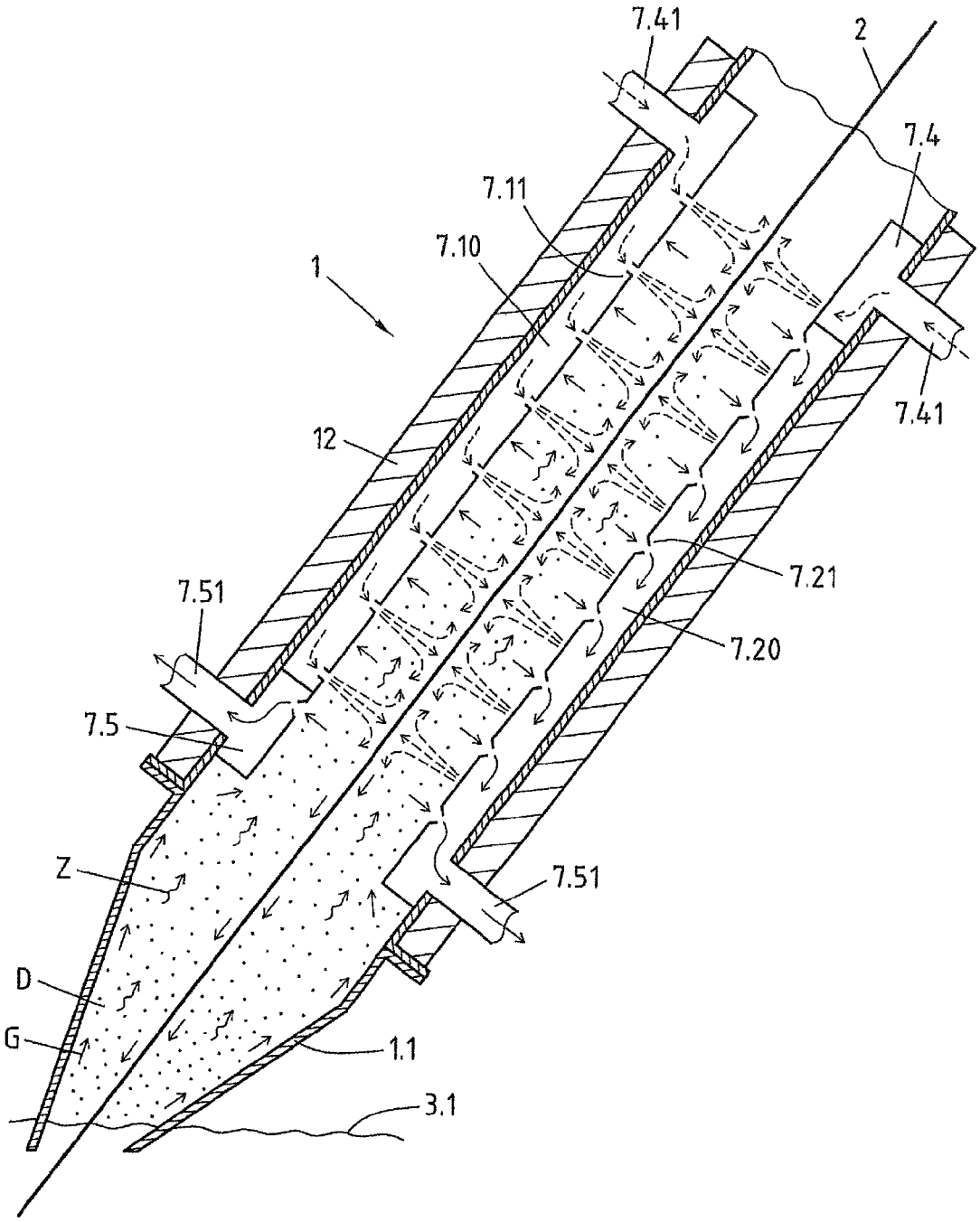
FIG. 4 is a cross-sectional, partial side view of a section of an embodiment of a furnace pipe used in a continuous strip galvanization process, as disclosed herein.

The injection and suction branches 7.10, 7.20 are provided with a multiplicity of openings (nozzles) 7.11, 7.21 which serve as injection openings or extraction openings. Said openings (nozzles) 7.11, 7.21 are arranged and designed in such a manner that the protective furnace gas flowing out of the injection openings 7.11 is directed onto or strikes against that surface of the strip 2 which faces the respective injection opening with an angle of impact within the range of 70° to 110°, preferably 80° to 100°. The injection nozzles 7.11 are preferably designed in such a manner that the protective furnace gas streaming out therefrom is directed substantially at right angles to the strip surface (cf. FIGS. 2 and 4). The distance between the respective injection nozzle 7.11 and at least one extraction opening 7.21 assigned thereto is selected here in such a manner that, at a predetermined or predeterminable flow velocity of the injected protective furnace gas, the entraining of protective furnace gas, which occurs during movement of the strip 2, in the direction of the zinc bath 3 is effectively interrupted or is at least minimized.

The entraining of protective furnace gas caused by the strip movement contributes to a "natural movement of gas". In addition, the natural movement of gas is driven by the customarily present temperature difference between the relatively hot protective furnace gas, which is entrained by the strip 2, above the zinc bath 3 and the colder protective furnace gas in the upper region of the pipe 1. By means of the interruption or blocking according to the invention of this natural movement of gas, the entraining or the transport of zinc vapour from the zinc bath surface 3.1 into the upper pipe region is interrupted or at least minimized at the same time.

In order to achieve as uniform a blocking effect as possible for the movement of gas in the strip running direction and for the upwardly directed movement of gas along the inside of the pipe walls without increased strip vibrations occurring in the process, at least five, preferably at least seven, particularly preferably at least ten injection openings (nozzles) 7.11 are arranged distributed over the width of the strip 2.

At least one extraction opening 7.21 is located in the direct vicinity of each injection opening 7.11. The injection openings 7.11 and the extraction openings 7.21 are arranged in the form of a matrix. The injection and extraction therefore take place in a plurality of stages, preferably in at least three stages. The injection openings 7.11 are arranged here offset with respect to the extraction openings 7.21, as viewed in the strip running direction and over the strip width (cf. FIG. 5). The injection openings 7.11 and the extraction openings 7.21 are preferably arranged uniformly spaced apart from one another.

A large quantity of protective furnace gas can be exchanged via the gas injection ducts 7.10 without a large amount of gas being transported in the strip running direction. In an advantageous manner, the strip 2 is thereby not caused to vibrate. At the same time, the undesirable transport of zinc vapour out of the immersion region of the strip 2 into the upper part of the pipe 1 is not assisted by the stream of gas.

By means of the alternating arrangement of injection nozzles 7.11 and suction nozzles 7.21 (FIG. 3), the flow can pass completely through the pipe cross section in the transverse direction. Protective furnace gas which is not yet loaded with zinc dust is mixed with protective furnace gas loaded with zinc dust and is extracted in the spatial vicinity.

Figure 3:
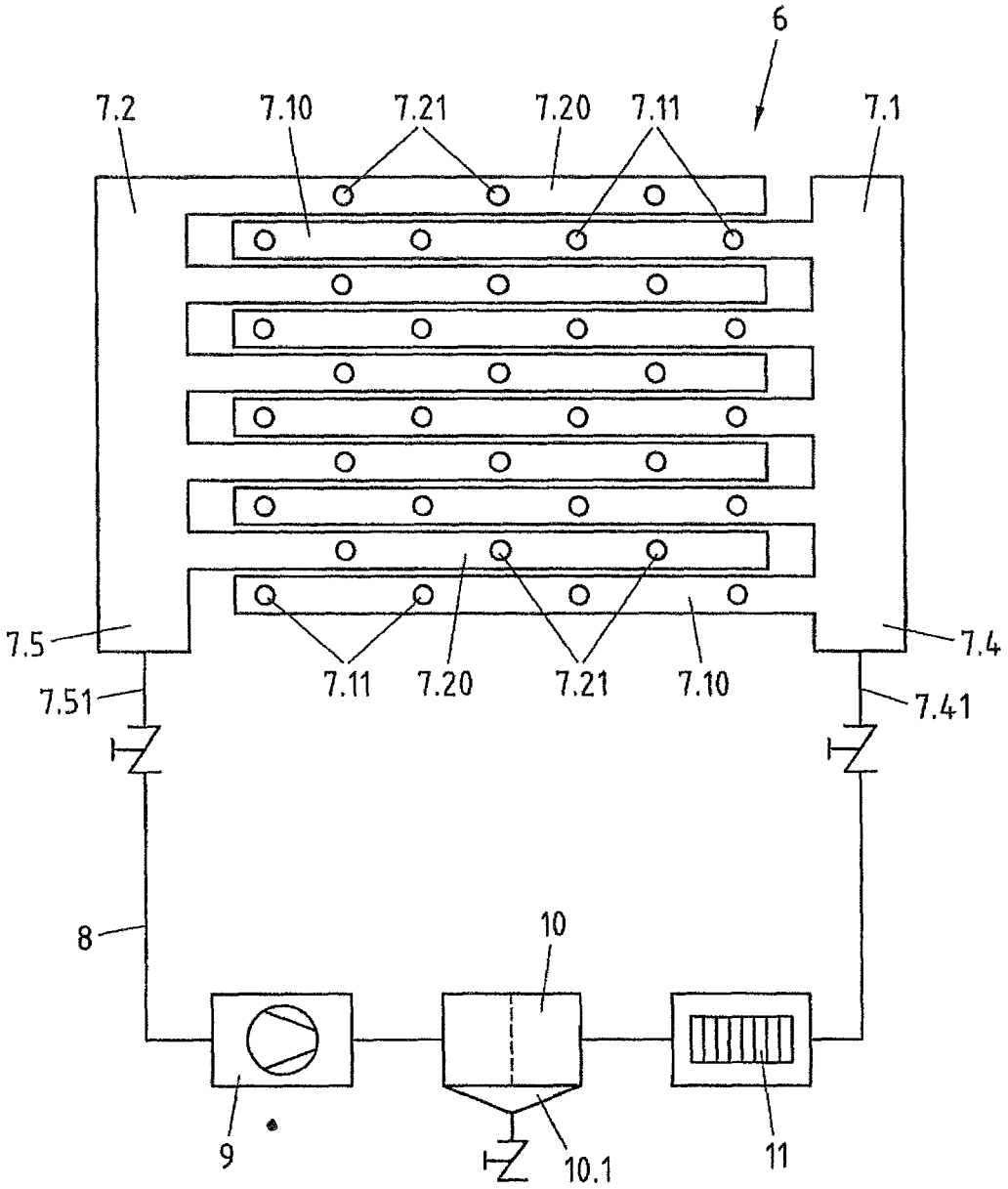
FIG. 3 is a schematic top view of a blowing/suction apparatus disposed in the furnace pipe of FIG. 1, including an associated return line having an extraction ventilator, a zinc separating apparatus, and a heating device for heating the protective furnace gas that is cleaned of zinc and is to be injected.

As sketched in FIG. 3, the blowing/suction apparatus 6 or the blowing/suction box 6.1, 6.2 can also be designed in such a manner that the injection openings 7.11 are formed on teeth-like branches 7.10 of a comb-shaped blow pipe structure 7.1 and the extraction openings 7.21 are formed on teeth-like branches 7.20 of a comb-shaped suction pipe structure 7.2, wherein the teeth-like branches 7.10 of the comb-shaped blow pipe structure 7.1 and the teeth-like branches 7.20 of the comb-shaped suction pipe structure 7.2 intermesh. This refinement makes it possible to adjust the distance of the injection openings 7.11 from the extraction openings 7.21 by displacing the comb-shaped blow pipe structure 7.1 relative to the comb-shaped suction pipe structure 7.2.

Apart from the suction fan or suction ventilator 9, a zinc separating apparatus 10 for cleaning the protective furnace gas loaded with zinc vapour and/or zinc dust is integrated in the return line 8. The zinc separating apparatus 10 is preferably provided with a cooling device which brings about resublimation of zinc vapour. The resulting zinc dust can be separated off from the protective furnace gas by means of a separating device and conducted into a collecting container 10.1.

The gradual injection of cleaned or unloaded protective furnace gas and the extraction, which takes place in the direct vicinity of the injection points, of protective furnace gas loaded with zinc vapour and/or zinc dust lowers the concentration of the zinc vapour and/or zinc dust in the protective furnace gas located in the pipe 1, and therefore the partial pressure of the zinc vapour, in a gradual manner to a noncritical mass. The gradual reduction in the content of zinc vapour and zinc dust in the protective furnace gas loaded therewith is sketched schematically in FIG. 4, wherein the spiral arrows Z represent zinc vapour, the straight arrows G indicate the direction of flow of the protective furnace gas in the pipe 1 and in the blowing/extraction apparatus (blowing/suction box) and the "spot clouds" D represent zinc dust. It can be seen that the content of zinc vapour and zinc dust gradually decreases from the zinc bath surface 3.1 in the direction of the annealing furnace.

The cleaned stream of protective furnace gas is heated up, for example to a temperature within the range of 450 to 600° C., by means of a gas heater 11 before injection. The pipe 1 together with the blowing/suction apparatus or the blowing/suction boxes 6.1, 6.2 is heated up by said stream of gas in such a manner that the temperature does not fall below the dewpoint or resublimation temperature of zinc vapour at any point in the pipe 1.

The gas injection ducts 7.10 run along the strip longitudinal axis or pipe longitudinal axis and parallel to the extraction lines 7.20 arranged in between. In combination with the extraction lines 7.20, the gas injection ducts 7.10 overlap a longitudinal section of the strip 2 completely or substantially completely both on the lower side of the strip and on the upper side of the strip. This brings about a uniform surface temperature of the blowing/suction apparatus or blowing/suction boxes 6.1, 6.2, wherein the surface temperature lies above the dewpoint or resublimation temperature of zinc vapour.

The apparatus 6 according to the invention is designed as a push-pull system. In this case, hot protective furnace gas is injected with a slight positive pressure into the pipe 1 via the injection openings 7.11 in order to produce transverse flows at the injection openings 7.11 (outlet points). The injected stream of protective furnace gas is adjusted so as to be identical to or slightly below the extracted quantity of the stream of gas via a measuring and control device. For example, the stream of protective furnace gas injected per strip side (blowing/suction box 6.1 or 6.2) is approximately 150 $Nm^3/h$ at approx. 600° C., while the stream of protective furnace gas, including zinc vapour, extracted per strip side is approx. 200 $Nm^3/h$.

In order to minimize heat losses, the blowing main chamber (blowing main line) 7.1 and the injection branches (gas injection ducts) 7.10 and preferably also the extraction main chamber 7.2 and the suction branches (extraction lines) 7.20 are thermally insulated from the pipe structure by a heat insulating layer. In addition, the pipe 1 is provided with external heat insulation 12 in order to keep the inside of the pipe walls to a temperature greater than 300° C.

The lowermost part of the pipe 1, i.e. the pipe end piece 1.1 located between the blowing/suction apparatus and the zinc bath 3, is preferably provided with heat insulation 13. The heat insulation 13 ensures that the walls or wall sections of the pipe that are provided therewith are hotter during the operation of the galvanization plant than the dewpoint or resublimation temperature of the mixture of protective furnace gas and zinc vapour. The heat insulation 13 is formed, for example, by mineral wool plates and/or ceramic plates and surrounds the pipe end piece 1.1 preferably in the form of a jacket.

Furthermore, in a further refinement of the invention, the pipe end piece 1.1 is provided with a heating device (not shown) in addition to or as an alternative to the heat insulation 13.

The furnace pipe 1 designed according to the invention can be divided into three regions A, B and C with respect to the protective furnace gas (cf. FIG. 1).

The region A includes the end piece 1.1, which is preferably provided with heat insulation 13. A relatively high load of zinc vapour occurs in this region A with little movement of the gas. The surface temperature of the pipe 1 is above 440° C. in this region.

The region A is adjoined by the region B which is equipped with the blowing/suction apparatus according to the invention (for example in the form of the blowing/suction boxes 6.1, 6.2). The region B serves as a separating block or gas veil. It interrupts the "natural stream of gas", in particular the entraining of protective furnace gas, which is caused by the strip movement, in the direction of the zinc bath 3, by injecting cleaned, hot protective furnace gas while simultaneously extracting protective furnace gas loaded with zinc vapour in the spatial vicinity of the injection points 7.11. By means of the multi-stage arrangement of the injection nozzles 7.11 and extraction nozzles 7.21, the concentration of zinc vapour is gradually reduced in the region B. The surface temperatures of the blowing/suction boxes 6.1, 6.2 and of the insides of the pipe 1 lie above the dewpoint or resublimation temperature of zinc vapour, i.e. above 400° C.

The region C follows above the region B. The region C is distinguished by a low content of zinc vapour in the protective furnace gas. The surface temperature of the inside of the pipe is more than 300° C. in the region C, as a result of which condensation or resublimation of the zinc vapour which is still slightly present there in the protective furnace gas is prevented.

The implementation of the invention is not restricted to the exemplary embodiments described above. On the contrary, numerous variants which, even in the event of a configuration deviating from the exemplary embodiments illustrated in the drawing, make use of the invention indicated in the appended patent claims are possible. For example, the injection branches 7.10 and suction branches 7.20, which run parallel to one another, of the blowing/suction box 6.1, 6.2 and the "teeth" of the comb-shaped blow pipe structure 7.1 and of the comb-shaped suction pipe structure 7.2 can also be oriented transversely with respect to the strip running direction. Which of these variants is realized depends on the course of the main lines for the supply and extraction of protective furnace gas with respect to the orientation of the pipe 1 and on the installation possibilities in this regard.

The invention claimed is:

1. A method for avoiding surface defects, which are caused by zinc dust, on a galvanized metal strip in continuous strip galvanization, in which metal strip heated in a continuous annealing furnace is moved through a furnace pipe in protective furnace gas and is immersed into a zinc bath, in which, in the furnace pipe, an upper side and a lower side of the metal strip are acted upon by protective furnace gas injected into the furnace pipe via injection openings, and protective furnace gas loaded with zinc vapour and/or zinc dust is extracted from the furnace pipe via extraction openings, which injection and extraction openings are both disposed in opposing walls of the furnace pipe on both sides of the metal strip, characterized in that each of the opposing walls of the furnace pipe on both sides of the metal strip include at least one series of at least five injection openings and at least one series of at least five extraction openings, such that the injection and extraction openings from each of the at least one series of injection and extraction openings are disposed across a width of a wall of the furnace pipe so as to be distributed over a width of the continuous metal strip passing through the furnace pipe, the at least one series of injection openings being alternatingly arranged in the strip running direction adjacent to the at least one series of extraction openings, and a multiplicity of the injection openings are configured and arranged in the furnace pipe in such a manner that the protective furnace gas streaming out of said injection openings is directed onto that surface of the metal strip which faces the respective injection opening with an angle of impact within the range of 70° to 110° wherein the distance between the respective injection opening and at least one extraction opening assigned thereto is selected in such a manner, and the flow velocity of the protective furnace gas emerging from the respective injection opening is controlled in such a manner, that an entraining of protective furnace gas, which occurs during movement of the metal strip, in the direction of the zinc bath is opposed.

2. The method of claim 1, wherein the protective furnace gas supplied via the injection openings is heated beforehand to a temperature of at least 500° C.

3. The method of claim 1, wherein the injection of protective furnace gas via the injection openings and the extraction of protective furnace gas via the extraction openings is carried out in at least three stages which are arranged consecutively in the strip running direction, wherein each of the stages is formed from a series of at least five injection openings and a series of at least five extraction openings.

4. The method of claim 1, wherein the furnace pipe is heated to a temperature of at least 400° C. at least in a region which extends from the zinc bath as far as the injection openings and/or extraction openings.

5. The method of claim 1, wherein the volumetric flow of protective furnace gas supplied via the injection openings is adjusted to be identical to the volumetric flow of protective furnace gas extracted via the extraction openings, or is adjusted to a value which lies at maximum 5% below the extracted volumetric flow of protective furnace gas.

6. The method of claim 1, wherein the extracted protective furnace gas loaded with zinc vapour and/or zinc dust is cleaned by means of a zinc separating apparatus.

7. The method of claim 1 wherein the protective furnace gas streaming out of the injection openings is directed onto the surface of the metal strip at angles of impact between 80° to 100°.

8. An apparatus for avoiding surface defects, which are caused by zinc dust, on galvanized metal strip in continuous strip galvanization, in which metal strip which is to be galvanized and is heated in a continuous annealing furnace is moved through a furnace pipe in protective furnace gas and is immersed into a zinc bath, the apparatus comprising a furnace pipe having at least one series of at least five injection openings configured to permit the protective furnace gas to be injected into the furnace pipe and act on an upper side and a lower side of the metal strip, and at least one series of at least five extraction openings configured to permit extraction of protective furnace gas loaded with zinc vapour and/or zinc dust from said furnace pipe, said injection and extraction openings from each of the respective at least one series of injection and extraction openings being disposed across a width of a wall of the furnace pipe so as to be distributed over a width of the continuous metal strip to be passed through the length of the furnace pipe, the at least one series of injection openings being alternatingly arranged in the strip running direction adjacent to the at least one series of extraction openings, characterized in that a multiplicity of the injection openings are configured and arranged in the furnace pipe in such a manner that the protective furnace gas streaming out of said injection openings is directed onto that surface of the metal strip which faces the respective injection opening with an angle of impact within the range of 70° to 110° wherein the distance between the respective injection opening and at least one extraction opening assigned thereto is selected in such a manner that, at a predetermined or predeterminable flow velocity of the protective furnace gas emerging from the respective injection opening, an entraining of protective furnace gas, which occurs during movement of the metal strip, in the direction of the zinc bath is opposed.

9. The apparatus of claim 8, wherein the extraction openings are connected to the injection openings via a return line having at least one extraction ventilator, wherein the return line is provided with at least one heating device for heating the protective furnace gas to a temperature of at least 500° C.

10. The apparatus of claim 9, wherein the return line is provided with a zinc separating apparatus.

11. The apparatus of claim 8, wherein the injection openings for injecting protective furnace gas and the extraction openings for extracting protective furnace gas are configured in at least three stages which are arranged consecutively in the strip running direction, wherein each of the stages is formed from a series of at least five injection openings and a series of at least five extraction openings.

12. The apparatus of claim 8, wherein the injection openings and the extraction openings are arranged in the form of a matrix.

13. The apparatus of claim 8, wherein the injection openings are arranged offset with respect to the extraction openings, as viewed in the strip running direction and over the strip width.

14. The apparatus of claim 8, wherein the injection openings and the extraction openings are arranged uniformly spaced apart from one another.

15. The apparatus of claim 8, wherein the injection openings are formed on teeth-like branches of a comb-shaped blow pipe structure and the extraction openings are formed on teeth-like branches of a comb-shaped suction pipe structure, wherein the teeth-like branches of the comb-shaped blow pipe structure and the teeth-like branches of the comb-shaped suction pipe structure intermesh.

16. The apparatus of claim 15, wherein the comb-shaped blow pipe structure and the comb-shaped suction pipe structure are thermally insulated in relation to the furnace pipe by heat insulation.

17. The apparatus of claim 8, wherein the furnace pipe is provided with heat insulation and/or a heating device at least in a region which extends from the zinc bath as far as the injection openings and/or extraction openings.

18. The apparatus of claim 8 wherein the protective furnace gas streaming out of the injection openings is directed onto the surface of the metal strip at angles of impact between 80° to 100°.

* * * * *